US009745531B2

(12) United States Patent
Choo et al.

(10) Patent No.: US 9,745,531 B2
(45) Date of Patent: Aug. 29, 2017

(54) FUEL LUBRICITY ADDITIVE

(75) Inventors: Yuen May Choo, Selangor Darul Ehsan (MY); Sit Foon Cheng, Selangor Darul Ehsan (MY); Ah Ngan Ma, Selangor Darul Ehsan (MY); Yusof Basiron, Selangor Darul Ehsan (MY)

(73) Assignee: MALAYSIAN PALM OIL BOARD, Kajang (MY)

( * ) Notice: Subject to any disclaimer, the term of this patent is extended or adjusted under 35 U.S.C. 154(b) by 1417 days.

(21) Appl. No.: 11/235,075

(22) Filed: Sep. 27, 2005

(65) Prior Publication Data

US 2006/0117648 A1 Jun. 8, 2006

(30) Foreign Application Priority Data

Sep. 28, 2004 (MY) ..... PI 2004 3958

(51) Int. Cl.
*C10L 1/19* (2006.01)
*C10L 5/08* (2006.01)
*C10L 10/08* (2006.01)

(52) U.S. Cl.
CPC ..... *C10L 10/08* (2013.01); *C10L 1/191* (2013.01)

(58) Field of Classification Search
CPC ..... C10M 129/70; C10M 129/72; C10L 1/02; C10L 1/08; C10L 1/1802
USPC ..... 44/389
See application file for complete search history.

(56) References Cited

U.S. PATENT DOCUMENTS 2,527,889 A * 10/1950 Fischer et al. ..... 44/304
3,273,981 A * 9/1966 Furey ..... 44/349
4,364,743 A * 12/1982 Erner ..... 44/388
4,920,691 A * 5/1990 Fainman ..... 44/389
5,773,391 A * 6/1998 Lawate et al. ..... 508/257
5,858,028 A * 1/1999 Davies et al. ..... 44/393
5,882,364 A * 3/1999 Dilworth ..... 44/400
5,958,089 A * 9/1999 Dillworth et al. ..... 44/347
5,993,498 A * 11/1999 Vrahopoulou et al. ..... 44/388
6,160,144 A * 12/2000 Bongardt et al. ..... 554/223
6,258,135 B1 * 7/2001 Caprotti et al. ..... 44/389
6,271,173 B1 * 8/2001 Khare ..... 502/406
2002/0033354 A1 * 3/2002 Khare ..... 208/15
2004/0250466 A1 * 12/2004 Fang et al. ..... 44/388

FOREIGN PATENT DOCUMENTS

WO WO 94/17160 * 1/1994 ..... C10L 1/18

* cited by examiner

*Primary Examiner* — Ellen McAvoy
*Assistant Examiner* — Ming Cheung Po
(74) *Attorney, Agent, or Firm* — Maier & Maier, PLLC

(57) ABSTRACT

A lubricity additive for fuels with sulphur content of not more than 0.05 wt % is described herein. The lubricity additive comprises a polyol ester or a mixture of polyol esters derived from $C_8$-$C_{18}$ saturated and/or unsaturated fatty acids. The polyol esters is produced by: i) esterification of a $C_8$-$C_{18}$ saturated or unsaturated fatty acids, or a mixture thereof, with a polyhydric alcohol; ii) transesterification of an oil or a mixture of oils, with fatty acid composition comprising $C_8$-$C_{18}$ saturated and/or unsaturated fatty acids, with a polyhydric alcohol. The preferred fatty acids are unsaturated $C_{18}$ fatty acids, more particularly, oleic acid whereas the preferred polyhydric alcohol is neopolyol, more particularly, trimethylol propane and its isomers. A fuel composition comprising a major amount of fuel with sulphur content of not more than 0.05 wt % and a minor amount of the lubricity additive is also described herein. The amount of the lubricity additive is not more than 0.1 wt %.

5 Claims, No Drawings

FUEL LUBRICITY ADDITIVE

FIELD OF INVENTION

The present invention relates to a lubricity additive for fuels with low sulphur content, particularly for fuels with sulphur content of not more than 0.05 weight percent.

BACKGROUND OF THE INVENTION

Driven by stringent regulatory requirements in the United States and Europe, increasingly severe specifications have been imposed to diesel fuels, particularly with respect to sulphur content and in some areas aromatic content. In United States, sulphur content in diesel fuel was limited to 0.05 weight percent (500 ppm) starting from 1993. Environmental Protection Agency (EPA) in United States would enforce further reduction in the near future as it has targeted sulphur content in diesel fuel as low as 0.0015 weight percent (15 ppm) by 2006.

Although the effort to reduce sulphur content in diesel fuel is seen as a positive step to protect our environment, the resultant fuel's performance is less satisfactory. Hydrotreating (hydrogenation) process which is use to reduce sulphur content in diesel fuel would also cause a reduction in fuel lubricity. Usage of diesel fuel with reduced lubricity may cause injection pump failures and accelerated engine wear.

Lubricity has been included into the automotive diesel fuel standard EN590 since 1999. It estimates a fuel's ability to protect fuel injection pumps against extra wear. Fuel Injection Equipment (FIE) Manufacturers adopted high frequency reciprocating rig (HFRR) test and all diesel fuels are recommended to meet a limit of 460 micron maximum wear scar diameter. A lower wear scar diameter indicates better lubricity.

European Patent Application No. 635 558 discloses a gas oil composition, with sulphur content of not more than 0.2 percent by weight (2000 ppm) and with aromatic hydrocarbons content of lower than about 30 percent by weight, containing, as a lubricity improver agent, an amount of 0.01 weight percent (100 ppm) to 1 weight percent (10000 ppm) of lower $C_1$-$C_5$ alkyl esters of a mixture of saturated and unsaturated $C_{12}C_{22}$ fatty acids, derived from vegetable oleaginous seeds. The vegetable oleaginous seeds are particularly rapeseed, sunflower and soybean seeds. The mixture of $C_{12}$-$C_{22}$ fatty acids contains from 5 to 20 weight percent of saturated fatty acids, from 70 to 95 weight percent of total mono-unsaturated and di-unsaturated fatty acids, and from 0 to 10 weight percent of total tri-unsaturated and tetra-unsaturated fatty acids.

U.S. Pat. No. 5,993,498 discloses a polyol ester distillate fuel additive wherein said ester is characterized as having about 1% to 35% unconverted hydroxyl groups or having a hydroxyl number of greater than about 5 to 140 and wherein said ester is a reaction product of a polyhydric alcohol with at least one branched and/or linear saturated monobasic acid or a reaction product of a polybasic acid with monohydric alcohol. It is observed that polyol esters having hydroxyl number of lower than 5 do not function well as lubricity additive.

U.S. Pat. No. 6,511,520 discloses a lubricity additive for diesel and aviation fuels with low sulphur content which comprises 5 to 25 weight percent of at least one glycerol monoester, 0.1 to 20 weight percent of at least one glycerol diester and 35 to 75 weight percent of at least one compound of formula $R_2$—C(O)—X, $R_2$ being an alkyl chain containing 8 to 24 carbon atoms, or a monocyclic or polycyclic group comprising 8 to 60 carbon atoms, and X being selected among (i) the groups of $OR_0$, $R_0$ being a hydrocarbon radical comprising 1 to 8 carbon atoms, optionally substituted by one or several esters; and (ii) the groups derived from primary or secondary amines and alkanolamines with aliphatic hydrocarbon chain, comprising 1 to 18 atoms.

One of the major disadvantages of the esters as disclosed above is their low lubricating power at a concentration of less than 0.5 weight percent in fuels with ultra low sulphur content, such as Class 1 Swedish diesel fuel.

SUMMARY OF THE INVENTION

A lubricity additive for fuels with sulphur content of not more than 0.05 weight percent (wt %) is described herein. The lubricity additive comprises a polyol ester or a mixture of polyol esters derived from $C_8$-$C_{18}$ saturated and/or unsaturated fatty acids. The polyol esters is produced by: i) esterification of a $C_8$-$C_{18}$ saturated or unsaturated fatty acids, or a mixture thereof, with a polyhydric alcohol; ii) transesterification of an oil or a mixture of oils, with fatty acid composition comprising $C_8$-$C_{18}$ saturated and/or unsaturated fatty acids, with a polyhydric alcohol. The preferred fatty acids are unsaturated $C_{18}$ fatty acids, more particularly, oleic acid whereas the preferred polyhydric alcohol is neopolyol, more particularly, trimethylol propane and its isomers. A fuel composition comprising a major amount of fuel with sulphur content of not more than 0.05 weight percent (wt %) and a minor amount of the lubricity additive is also described herein. The amount of the lubricity additive is not more than 0.1 weight percent (wt %).

DESCRIPTION OF THE INVENTION

The inventors of present invention unexpectedly found that polyol esters, derived from $C_8$-$C_{18}$ saturated and/or unsaturated fatty acids, could perform well as lubricity additive for fuels with low sulphur content at a low treat rate even when they are having a hydroxyl number of not more than 5.

One aspect of the present invention discloses a fuel lubricity additive which comprises a polyol ester or a mixture of polyol esters derived from $C_8$-$C_{18}$ saturated and/or unsaturated fatty acids.

Another aspect of the present invention discloses a fuel composition comprising a major amount of fuel with low sulphur content and a minor amount of the fuel lubricity additive. The term 'minor amount' refers to an amount of less than 0.1 weight percent (1000 ppm). The fuel is particularly fuels with sulphur content of not more than 0.05 weight percent, more particularly fuels with sulphur content of not more than 0.005 weight percent. Examples of fuels are biofuels and middle distillate fuels such as Class 1 Swedish diesel fuel and jet fuel.

The polyol esters disclosed herein is produced in a known manner by:

i) esterification of a $C_8$-$C_{18}$ saturated or unsaturated fatty acid with a polyhydric alcohol; or ii) esterification of a mixture of $C_8$-$C_{18}$ saturated and/or unsaturated fatty acids with a polyhydric alcohol; or iii) transesterification of an oil or a mixture of oils, with fatty acid composition comprising $C_8$-$C_{18}$ saturated and/or unsaturated fatty acids, with a polyhydric alcohol.

The preferred fatty acids are unsaturated $C_{18}$ fatty acids and more particularly oleic acid. The mixture of $C_8$-$C_{18}$ saturated and/or unsaturated fatty acids preferably has a fatty acid composition comprising minimum 15 weight percent of unsaturated $C_{18}$ fatty acids, more particularly has a fatty acid composition comprising minimum 15 weight percent of oleic acid. The oil with fatty acid composition comprising $C_8$-$C_{18}$ saturated and/or unsaturated fatty acids is selected from palm oil, palm kernel oil, groundnut oil, coconut oil, soybean oil, rapeseed oil, olive oil, sunflower oil, cottonseed oil, tall oil or a mixture thereof, preferably an oil or a mixture of oils with fatty acid composition comprising minimum 15 weight percent of unsaturated $C_{18}$ fatty acids, more particularly with fatty acid composition comprising minimum 15 weight percent of oleic acid. The preferred polyhydric alcohol is neopolyol namely neopentyl glycols, trimethylol propane, trimethylol ethane, pentaerythritol, ethylene glycol, diethyl propane and their isomers, more particularly trimethylol propane and its isomers. The preferred polyol esters are oleate esters of trimethylol propane which include trimethylol propane monooleate, trimethylol propane dioleate, trimethylol propane trioleate or a mixture thereof.

The following examples are presented to illustrate the present invention in a non-limiting sense.

EXAMPLE 1

Preparation of Oleate Esters of Trimethylol Propane

Oleate esters of trimethylol propane were prepared by esterifying 4 moles of oleic acid with 1 mole of trimethylol propane at 160° C. in the presence of 1 weight percent of sulphuric acid based on the weight of oleic acid used. 1 mole of toluene was added to the reaction mixture as azeotroping agent. Water formed during the reaction was removed continuously by distillation while distilled toluene was recycled continuously into the reaction mixture. Products formed from the reaction were neutralized and then subjected to purification process by elucidating it through a column packed with silica gel to obtain oleate esters of trimethylol propane.

EXAMPLE 2

HFRR Test on Fuel Samples

Fuel samples were prepared by blending oleate esters of timethylol propane from Example 1 (hereinafter referred as test additive) with a base fuel. Three base fuels with different sulphur content were used for preparation of fuel samples to illustrate the effective treat rate of test additive. The base fuels used were ultra low sulphur diesels (ULSD) with sulphur content of 0.005 weight percent (50 ppm), 0.0042 weight percent (42 ppm) and 0.002 weight percent (20 ppm).

The homogenized fuel samples were subjected to HFRR test according to ASTM D6079. A wear scar diameter of less than 460 micron was considered to be acceptable. The HFRR test results are tabulated in Table 1.

TABLE 1

| Fuel Sample | Base Fuel | Sulphur Content (ppm) | Treat Rate of Test Additive (ppm) | Wear Scar Diameter (micron) |
|---|---|---|---|---|
| A | USDL1 | 50 | 100 | 479 |
| B | USDL1 | 50 | 200 | 364 |
| C | USDL1 | 50 | 0 | 526 |
| D | USDL2 | 42 | 100 | 507 |
| E | USDL2 | 42 | 200 | 402 |
| F | USDL2 | 42 | 0 | 545 |
| G | USDL3 | 20 | 100 | 518 |
| H | USDL3 | 20 | 200 | 464 |
| I | USDL3 | 20 | 500 | 359 |
| J | USDL3 | 20 | 0 | 617 |

The fuel lubricity additive disclosed herein is able to bring significant lubricity improvement in fuels with low sulphur content at a very low treat rate. Fuel compositions comprising the fuel lubricity additive of present invention showed an acceptable wear scar diameter in HFRR test.

The invention claimed is:

1. A fuel composition consisting of diesel fuel having a sulphur content of not more than 0.05 weight percent and a lubricity additive content of 0.02 to 0.1 weight percent, wherein the lubricity additive has a hydroxyl value of less than 4 and consists of a neopolyol oleate ester produced by transesterification of an oil or a mixture of oils, wherein the oil is selected from palm oil, palm kernel oil, groundnut oil, coconut oil, soybean oil, rapeseed oil, olive oil, sunflower oil, cottonseed oil, tall oil or a mixture thereof, and wherein the neopolyol is selected from neopentyl glycols and trimethylol ethane.

2. The fuel composition as claimed in claim 1 wherein the neopolyol is trimethylol ethane.

3. The fuel composition as claimed in claim 1 wherein the diesel fuel has a sulphur content of not more than 0.005 weight percent.

4. The fuel composition as claimed in claim 1, wherein the oil is palm oil, palm kernel oil or a mixture thereof.

5. The fuel composition as claimed in claim 1, wherein the neopolyol is neopentyl glycol.

* * * * *